United States Patent [19]

Penzias

[11] 4,075,937

[45] Feb. 28, 1978

[54] METHOD AND APPARATUS FOR FEEDING ROD-LIKE ARTICLES

[75] Inventor: Rolf Penzias, London, England

[73] Assignee: Molins Limited, England

[21] Appl. No.: 668,303

[22] Filed: Mar. 18, 1976

[30] Foreign Application Priority Data

Mar. 25, 1975 United Kingdom ..... 12351/75

[51] Int. Cl.[2] ..... A24C 5/50

[52] U.S. Cl. ..... 93/77 FT; 198/461

[58] Field of Search ..... 93/1 C, 77 FT; 198/461

[56] References Cited

U.S. PATENT DOCUMENTS

| | | | |
|---|---|---|---|
| 2,570,265 | 10/1951 | Nordquist et al. | 198/461 X |
| 2,809,639 | 10/1957 | Edwards | 131/94 |
| 2,957,285 | 10/1960 | Molins | 93/1 C |
| 3,267,821 | 8/1966 | Rowlands | 93/1 C |
| 3,872,779 | 3/1975 | Jackson | 93/1 C |

*Primary Examiner*—James F. Coan

*Attorney, Agent, or Firm*—Craig & Antonelli

[57] ABSTRACT

In the production of composite filter rod, from which composite filters for attachment to tobacco sections to form filter cigarettes are obtained, groups of alternating filter portions of different materials are fed along a path which diverges from the path of a feed member so that the groups are conveyed with a reducing component velocity. The filter portions pass into a garniture in which a continuous rod is formed and the feed member is synchronized with a continuous rod cut-off so that the rod is cut at predetermined positions in relation to its component filter portions.

14 Claims, 2 Drawing Figures

METHOD AND APPARATUS FOR FEEDING ROD-LIKE ARTICLES

This invention relates to a method and apparatus for feeding rod-like articles. In particular the invention is concerned with the formation of a composite rod composed of at least two different types of component rod-like articles.

Filter portions for attachment to plain cigarette lengths often comprise two or more different components, usually in axial abutment. Such portions, referred to as composite filter portions, may be produced from a continuous rod comprising a continuous wrapper surrounding, for example, a succession of alternate component filter portions of different materials. The rod is subsequently cut at regular intervals, for example through the middle of every portion of one of the filter materials, to form filter lengths for use by a filter attachment machine. In this machine the filter lengths may be introduced between and joined to two plain cigarette lengths and then cut in half to produce two filter cigarettes, each half of the filter length being attached to a cigarette length and comprising a composite filter portion having two half portions of the different filter materials. The present invention is applicable to the assembly and feeding of component filter portions to form a composite filter rod.

It should be understood that the composite filter rod may be cut by a continuous rod cut-off mechanism, to produce the composite filter lengths referred to above, while the rod is moving at high speed. In order that the rod should be cut precisely in the correct positions in relation to the different components of the rod it is important that the feed of the components and the cut-off mechanism should be accurately synchronised. In order to achieve this, individual component filter portions or groups thereof may be positively fed in predetermined order and in timed sequence onto a continuous wrapper just prior to entry into a garniture where the wrapper is continuously wrapped around the component filter portions. Where a continuous stream of abutting filter components is required the velocities of the feed means and the continuous wrapper must be such that the gaps between groups delivered by the feed means substantially disappear before the components are wrapped.

One aspect of the invention provides a method of feeding rod-like articles in succession in which groups of endwise-moving rod-like articles are conveyed along part of a first path by a feed member which follows said path, and delivered onto a second path which diverges from the first path so that the velocity of groups conveyed by the feed member is progressively reduced as the first and second paths diverge. Preferably the first path is circular and the feed member is moved around said path at constant speed. The rod-like articles may be sealed in a wrapper to form a continuous rod and divided into separate rods by dividing means while on said second path, the feed member and the dividing means being synchronised.

Another aspect of the invention provides apparatus for feeding rod-like articles in succession in an endwise-moving direction, comprising at least one feed member movable along a first path; means for feeding groups of rod-like articles onto the first path so that the groups are conveyed endwise by a feed member; and guide means defining a second path which diverges from the first path, each group being delivered along the second path by a feed member, the feed member or members being arranged to project into the first portion of the second path so that a feed member may remain in contact with and convey a group after it has been delivered onto the second path. The disposition of the first and second paths and the feed member or members is preferably such that a group is conveyed with a progressively decreasing component velocity as it is transferred from the first to the second path and along said first portion of the second path.

In a preferred arrangement a plurality of feed members in the form of circumferentially-spaced radially-extending fingers are arranged on a rotatable disc drive member. The first path is preferably circular. The second path preferably diverges from the first path at an angle greater than that of a tangent to the disc; i.e., there is a distinct directional change between the first and second paths. The feed fingers preferably have profiled end surfaces which are adapted to engage the trailing surface of the rear member of a group, both while it is on the first path and while it is on said first portion of the second path. The feed fingers may be retractable after the rear member of a group has been fed onto said first portion of the second path, so that there is a reduced risk of damage to the end of said member as said first and second paths diverge.

Groups of, for example, four or six rod-like articles may be fed onto the first path in succession. It is conceivable that a group could comprise a single rod-like article. The or each feed member is preferably moved along the first path at constant speed. It has already been noted that the first and second paths and the feed members may be disposed so that the groups are conveyed with a progressively reducing velocity on the second path as the feed member moves through said first portion of the second path. As a result of this lowering of feed velocity, gaps between groups delivered onto the first path are reduced on the second path and, in the absence of further conveying means associated with the second path, are closed up as each successive group is moved into engagement with the previous group delivered to the second path.

For production of a continuous composite rod comprising an abutting stream of component filter portions the rate of supply of filter portions onto the first path should be equal to the rate of flow of filter portions through the garniture in which the rod is formed. Thus, as there are gaps between the groups delivered onto the first path, the initial velocity of the filter portions on the first path is higher than their speed through the garniture. Hence the speed of filter portions conveyed by the feed members is reduced: this is achieved by the directional change between the first and second paths, during which the feed members continue to convey groups with a reducing component velocity. The final velocity of the filter portions as conveyed by the feed members may be less than garniture velocity but collation, i.e., timing by engagement of the feed member behind a substantially continuous stream of filter portions stretching into the garniture, takes place at a collation point where the velocity of the feed member equals that of the garniture tape.

The distance between the collation point and first contact with further feeding means such as the continuous wrapper is preferably approximately equal to the length of a group. The second path between the release point (i.e., the end of said first portion) and the continuous wrapper is preferably straight.

The invention will now be further described with reference to the accompanying drawings in which.

Figures 1, 2:
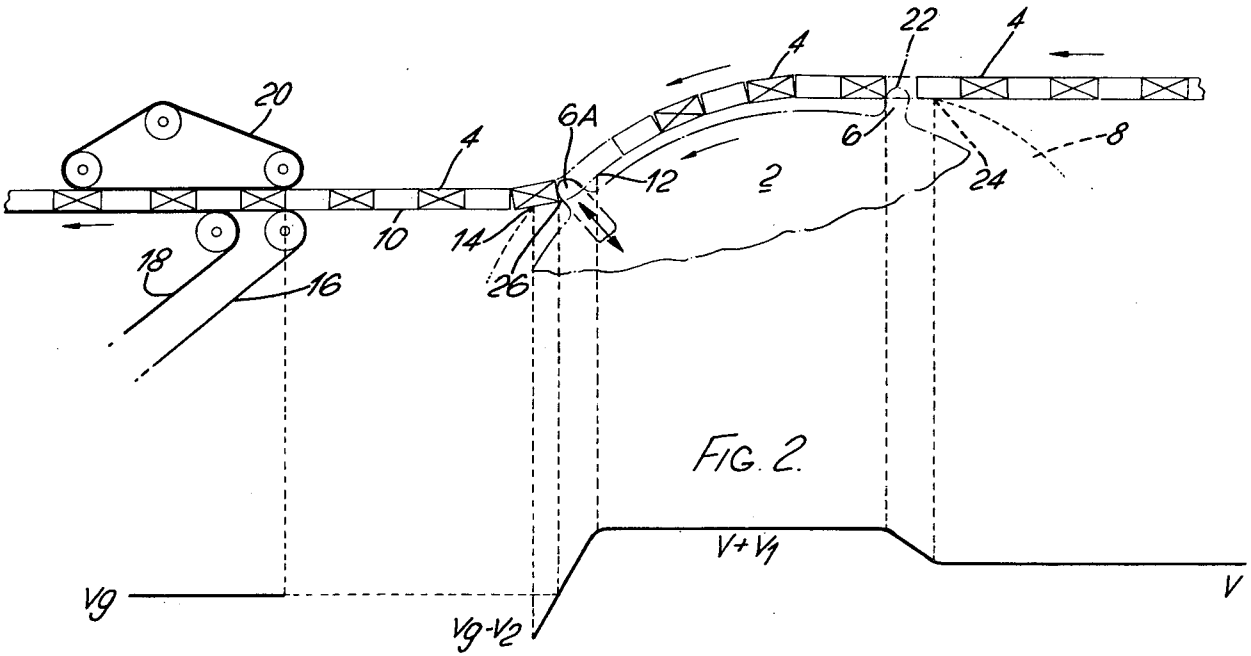
FIG. 1 is a diagram of apparatus for feeding component filter portions.
FIG. 2 is a diagram indicating the velocities of articles fed by the apparatus of FIG. 1.

The invention is described with reference to the feeding and assembly of a composite rod including two different filter materials, but it should be understood that the invention can in principle be used also in the assembly of a rod with only one or three or more types of filter material. The term "filter" is used throughout the specification to include any mouthpiece suitable for attachment to a tobacco section to produce a tipped cigarette, irrespective of whether the mouthpiece does or is intended to act as a filter.

FIG. 1 shows part of a rotatable turntable 2 onto which are fed groups 4 of six component filter portions, alternately of different materials. The groups 4 may be delivered to the turntable 2 by another turntable or similar feed device (not shown). The turntable 2 has a number of equally spaced radially extending fingers 6 projecting from its periphery and these follow a first path 8 as the turntable is rotated. The fingers can be fixed relative to the turntable 2 or may be retractable as indicated at 6A.

As groups 4 are successively fed onto the path 8 a finger 6 engages the trailing end of the rear filter portion of a group and conveys it along the path 8. It should be understood that the course followed by the groups 4 is defined by guide elements which are not shown in the drawing. A second path 10 (defined by said guide elements, which could comprise side rails on either side of a support surface) diverges from a position 12 on the first path 8. The fingers 6, while remaining in the first path 8, can also project into the first portion of the second path 10 so that they remain in contact with the rear filter portion of a group between the position 12 and a release point 14 on the second path. From the release point 14 the second path 10 straightens and leads onto a continuous wrapper 16 carried by a garniture tape 18 and under a top control band 20.

In order that the fingers 6 are able to convey the groups 4 in the first portion of the second path 10 (between the positions 12 and 14) the leading end face of each finger is bevelled or rounded as indicated at 22 so that there is less possibility of damage to the trailing surface of the filter portion with which it is in contact. The end of the fingers 6 may be profiled so as to maintain substantially normal contact with this surface from the pick-up point through to the release point. The fingers 6 may be retractable so that they are withdrawn after they have conveyed the groups 4 through a sufficient distance of the second path.

It will be appreciated that FIG. 1 is diagrammatic and that normally the turntable 2 will be in a horizontal plane (and will therefore be rotatable about a vertical axis) while the bands 18 and 20 and the wrapper 16 lie in substantially vertical planes and pass around horizontal axes.

The rate of delivery of filter portions onto the turntable 2 is arranged to be the same as the rate of flow of filter portions through the garniture on the wrapper 16 and garniture tape 18. Referring now also to FIG. 2 which diagrammatically indicates the velocities of filter portions passing through the apparatus of FIG. 1, the velocity of filter portions delivered onto the turntable 2 is V: this is greater than the velocity Vg of filter portions conveyed by the garniture tape since there are gaps (between groups) in the flow to the turntable. In the region of the pick-up point 24, where a group 4 is transferred onto the first path 8 in front of a finger 6, there is a slight increase in velocity to $V + v_1$. This makes the transfer slightly easier but in practice $v_1$ could be zero.

The turntable 2 is rotated at constant speed and carries the fingers 6 around the first path 8 at a velocity $V + v_1$. Between the pick-up point 24 and the position 12 the fingers 6 convey groups 4 at this velocity but after the position 12 (when the second path 10 which is followed by the groups 4 begins to diverge from the first path 8) the groups are conveyed with a progressively decreasing component velocity due to the increasing relative angles between the first and second paths until at the position 14 the fingers move out of engagement with the groups.

At a position 26 the velocity of a finger 6 is equal to the velocity of the garniture tape *Vg*. This is the collation point and in this position the finger has substantially closed any gaps between the group it is conveying and the previous group (and any gaps still remaining in or between previous groups).

As can be seen by reference to FIG. 2 the velocity of a finger 6 falls below garniture velocity Vg between the collation point 26 and the release point 14 to a value $Vg - V_2$. In an alternative arrangement $V_2$ could be zero. In fact the collation point could be substantially coincident with the release point but in this case it might be preferable to use retractable fingers 6A so that the fingers need not engage the end of the trailing article of a group at or near its edge at the release point.

It will be noted from FIG. 1 that the distance between the collation point 26 and the start of the wrapper 16 and the band 20 is slightly less than the length of a group. Thus the leading filter portion of a group is gripped by the wrapper and band and conveyed at garniture velocity before the velocity of the finger falls below garniture velocity. The remainder of the group is subsequently conveyed at the decreasing velocity of the finger until this passes the release point, after which the group remainder is stationary for a short time between the release point 14 and the wrapper 16 (and is supported on a dead plate forming part of said guide elements). It will be understood that the distance between the release point and the wrapper may be such that one or more of the remainder of the group may be gripped and conveyed by the wrapper 16 and band 20 before the finger 6 reaches the release point.

Thus, after a finger 6 has just passed the release point 14, there will be a number of gaps in the stream between the next finger 6 and the continuous stream in the garniture. There is one gap between the group conveyed by the said next finger and the remainder of the previous group stationary just beyond the release point. There is another gap between this stationary group remainder and the last filter portion to be gripped by the wrapper 16 and band 20. If said last filter portion was not the leading member of the previous group there will be a gap between it and the next filter portion on the wrapper and there may be further gaps between filter portions on the wrapper up to the last filter portion to be positively collated by the finger which has just passed the release point. In the arrangement described this last positively collated filter portion is the leading filter portion of the group conveyed by the finger but with varying distances between the wrapper and the collation point it could be any filter portion in the conveyed group, or even a member of a previous group.

The gaps in the stream are substantially closed when the next finger 6 reaches the collation point 26, since at that position the whole stream in front of the finger should by moving at garniture velocity Vg. It is at this position that the accurate synchronisation or timing between the turntable 2 and the cut-off in the garniture is related to the feed of the alternating stream. It will be realised that some movement of filter portions relative to the wrapper under action of the fingers 6 will be required to close gaps, e.g. between the last positively collated filter portion and the next filter portion. The dimensions of the apparatus should be such that these gaps are closed before they progress too far into the garniture (i.e., at least before the wrapper is sealed around the filter portions).

The apparatus of FIG. 1 can be used to deliver a collated stream of alternating filter portions into the garniture of a machine for producing composite filter rod. Thus the present apparatus may replace the cam track mechanism used to collate a stream of alternating filter portions as described with reference to FIGS. 3 and 4 of our copending British application No. 10896/75, which is referred to in its entirety. In fact the present apparatus can be incorporated as a replacement for the collating cam track mechanism in any of the arrangements for a composite filter rod machine referred to or illustrated in that application.

I claim:

1. A method of feeding rod-like articles in succession, comprising the steps of conveying groups of endwise-moving rod-like articles along part of a first path at substantially constant speed by means of a feed member which follows said path at said constant speed, delivering said groups onto a second path which diverges from the first path, and continuing to convey said groups with said feed member along an initial part of said second path so that the groups are conveyed by the feed member traveling along said first path at a progressively reducing component of said constant speed in the direction of said second path as the first and second paths diverge.

2. A method according to claim 1 in which the first path is circular and the second path diverges from the first path at an angle greater than that of a tangent to said first path.

3. A method according to claim 1 in which the rod-like articles are further conveyed along said second path as a substantially continuous stream travelling at a speed which is less than that of said feed member.

4. A method according to claim 3, further comprising wrapping and sealing the continuous stream to form a continuous rod and subsequently dividing said rod into separate portions with dividing means whilst on said second path, the feed member and the dividing means being synchronised so that the continuous rod is divided at predetermined positions in relation to the component rod-like articles of said groups.

5. A method according to claim 3 in which the groups are conveyed on said second path at a component speed which is less than the speed at which said articles are conveyed as a continuous stream on said second path.

6. A method according to claim 3 in which successive groups are each delivered by feed members onto said second path, wherein the second of said successive groups catches up with the first of said groups on said second path so that the feed member for said second group conveys at least some articles of said first group as well as those of the second group on said second path.

7. Apparatus for feeding rod-like articles in succession in an endwise-moving direction, comprising at least one feed member movable along a first path; means for feeding groups of rod-like articles onto the first path so that the articles in each group are conveyed endwise by a feed member engaging the rearmost article in the group; means for moving the feed member along said first path at substantially constant speed; and guide means defining a second path which diverges from the first path, each group being delivered along the second path by a feed member, the feed member being arranged to project into a first portion of the second path so that said feed member may remain in contact with and convey a group along said first portion of the second path as said feed member travels along said first path, the first and second paths and the feed member being so disposed that the component speed of the feed member along said first portion of the second path is progressively reduced as said feed member is moved at constant speed along said first path.

8. Apparatus according to claim 5 in which the first path is circular.

9. Apparatus according to claim 5, including a rotatable disc drive member, which carries a plurality of feed members in the form of circumferentially-spaced radially-extending fingers.

10. Apparatus according to claim 9 in which the fingers have profiled end surfaces adapted to engage the trailing surface of the rear member of a group.

11. Apparatus according to claim 9 in which the fingers are arranged to be retractable.

12. Apparatus according to claim 5, including further conveyor means associated with said second path, and means for forming a continuous rod from articles conveyed on said second path, wherein cutting means synchronised with said feed member is arranged to divide said rod at predetermined positions.

13. Apparatus according to claim 7 in which the second path diverges from the first path at an angle greater than that of a tangent to said first path.

14. Apparatus for feeding rod-like articles in succession in an endwise-moving direction, comprising a rotatable disc drive member; a plurality of circumferentially-spaced radially-extending retractable fingers carried by said drive member and movable along a first path; means for feeding groups of rod-like articles onto the first path so that the articles in each group are conveyed by a finger; and guide means defining a second path which diverges from the first path, each group being delivered along the second path by a finger, the fingers being arranged to project into a first portion of the second path so that a finger may remain in contact with and convey a group after it has been delivered onto the second path.

* * * * *